US005191760A

United States Patent [19]

Ball et al.

[11] Patent Number: 5,191,760

[45] Date of Patent: Mar. 9, 1993

[54] PROCESS AND DEVICE FOR PIECING ON AN OPEN-END SPINNING DEVICE

[75] Inventors: Anthony A. Ball, Reichertshausen; Ulrich Rodiger, Ingolstadt, both of Fed. Rep. of Germany

[73] Assignee: Schubert & Salzer Maschinenfabrik AG, Ingolstadt, Fed. Rep. of Germany

[21] Appl. No.: 686,871

[22] Filed: Apr. 16, 1991

Related U.S. Application Data

[63] Continuation of Ser. No. 467,022, Jan. 18, 1989, abandoned.

[30] Foreign Application Priority Data

Feb. 9, 1989 [DE] Fed. Rep. of Germany ..... 3903782

[51] Int. Cl.[5] ..... D01H 15/00

[52] U.S. Cl. ..... 57/263

[58] Field of Search ..... 57/261, 262, 263, 80, 57/81, 83, 85

[56] References Cited

U.S. PATENT DOCUMENTS

| | | | |
|---|---|---|---|
| 3,354,631 | 11/1967 | Elias et al. | 57/263 |
| 3,521,440 | 7/1970 | Oskin et al. | 57/263 |
| 4,384,451 | 5/1983 | Elias et al. | 57/263 |
| 4,497,166 | 2/1985 | Artzt et al. | 57/263 |
| 4,676,059 | 6/1987 | Artzt et al. | 57/263 |
| 4,838,018 | 6/1989 | Hoeber | 57/263 |

FOREIGN PATENT DOCUMENTS

| | | |
|---|---|---|
| 1228534 | 11/1972 | United Kingdom . |
| 1296461 | 11/1972 | United Kingdom . |

*Primary Examiner*—Daniel P. Stodola
*Assistant Examiner*—Paul Bowen
*Attorney, Agent, or Firm*—Dority & Manning

[57] ABSTRACT

A yarn piecing device and process for an open-end spinning machine wherein opened fiber is fed to a fiber collection surface in a pneumatic stream. The stream of fibers is shifted from the fiber collection surface when a broken or missing yarn is detected and the fiber feed to an opening device is interrupted. After the yarn is back-fed to the collection surface, the fiber feed to the opening device is restarted and the pneumatic stream of fibers is shifted back to the fiber collection surface before the fiber density in the pneumatic stream attains its production strength density.

10 Claims, 2 Drawing Sheets

100%
0
100%
t0
t1
t2
t5
t3
t4
t
A
AG
FF

100%
0
100%
C
B
FF
AG
t1
t5
t0
t3
t4
t2
t
FF

100%
0
100%
G
AG"
E
D
AG'
FF
F
t1
t5
t6
t0
t3
t4
t2
t
FF 1
411
41
410
400
4
121
122
401
42
12
412
120
405
440
123
44
420
10
402
403
431
10
430
40
404
140
14
141
460
43
432
30
15
142
406
46
132
118
119
11
51
131
50
5
450
451
130
117
115
13
111
45
452
407
136
P
113
133
110
116
134
112
135
114
32
31
2
3
33

PROCESS AND DEVICE FOR PIECING ON AN OPEN-END SPINNING DEVICE

This is a continuation of application Ser. No. 07/467,022, filed Jan. 18, 1989, which was abandoned upon the filing hereof.

BACKGROUND OF THE INVENTION

The instant invention relates to a process for piecing yarn on an open-end spinning device in which a fiber feeding device is turned on and whereby the produced fiber stream is deflected on its way to a fiber collection surface, and is removed until the actual piecing process is initiated, through the backfeeding of the yarn; whereupon the fiber stream is again deflected in synchronization with this backfeeding and is conveyed to the fiber collection surface. The invention also relates as well to a device to carry out the process.

A process of this type as well as a device to carry it out are known from the international patent application WO 86/01235, corresponding to U.S. Pat. No. 4,676,059. By means of this known process and device, it is intended to prevent the fibers which have suffered during the stoppage before the piecing process, from being guided into the spinning device, and to ensure that only fibers of perfect quality enter the spinning rotor. It has, however, been found to be extremely difficult to adapt yarn draw-off to the arrival of fibers, which takes effect suddenly in the spinning device after release of fiber feeding, so that the piecing joint deviates considerably in thickness from the normal yarn thickness. In order to remedy this disadvantage, it has been proposed, according to the above-mentioned patent application, to control the switch-over of the previously removed fiber stream gradually, so that the fiber stream becomes effective only gradually in the spinning device. However, a control device which is complicated, and must also be controlled with the utmost precision is required for this. It has also been shown that in practice, satisfactory results cannot be achieved in this way.

SUMMARY OF THE INVENTION

It is, therefore, the object of the instant invention to provide a process and a device which makes it possible, in a much simpler manner, to tie the fiber draw-off speed to the beginning of the fiber feeding action in the spinning device.

This object is attained with a process in which the deflection of the fiber stream back to the collection surface occurs before said fiber stream, started by the fiber feeding device being switched off, reaches its full strength. In this manner, the first fibers which may have suffered from having been interlaced or ground off are first removed. Since the fiber tuft found in the fiber feeding device is combed out more or less vigorously depending on the stoppage time, it always takes a certain time, depending on this stoppage, until the fiber stream has again reached its full strength, as during production. This fact is utilized, according to the invention, in that the deflection of the fiber stream is terminated, and the supply of fiber to the collection surface is started before the fiber stream regains its full strength. The fiber stream now entering the spinning device is, therefore, considerably thinner than during production and increases only gradually. It is, therefore, much easier to draw off the yarn from the spinning device at a speed adjusted to this decrease of the fiber stream. As a result, an unobtrusive piecing joint is obtained.

In an advantageous embodiment of the process according to the invention, the suction is switched off after switching on the fiber feeding even before the fiber stream (which starts up again as a result of the fiber feeding device being switched on) reaches its full strength, and the speed of the yarn draw-off is adapted to the increase of the fiber stream. In this manner, easy control of the fiber stream is possible for the piecing process.

Since the increase of the fiber stream depends, essentially, on the stoppage time of the fiber feeding device before the piecing process, yarn draw-off is controlled as a function of the combed-out state of the fiber tuft in an advantageous further development of the process according to the invention. Provisions are appropriately made in this case in order to control the acceleration of the fiber draw-off as a function of the combed-out state of the fiber tuft so that when the fiber tuft is greatly impaired, the yarn draw-off speed is accelerated more slowly than when it is less impaired. By taking into account the combed-out state of the fiber tuft in accelerating the yarn draw-off speed, optimal adaptation of the yarn draw-off, to the extent to which fiber feeding into the spinning device becomes effective, is achieved.

Adjustment to the stoppage time of the fiber feeding device and thereby, to the impairment of the fiber tuft, can also take place according to the invention in addition to, or instead of, the control of the yarn draw-off in that yarn draw-off begins later in case of great impairment of the fiber tuft than when the impairment is slighter.

It has been shown to be advantageous to ascertain the combed-out state of the fiber tuft and to control the onset and/or the speed of yarn draw-off as a function of the ascertained state of the fiber tuft.

The combed-out state of the fiber tuft can be ascertained by different methods, but it has been shown to be especially advantageous to derive the combed-out state of the fiber tuft from the stoppage time of the fiber sliver while the opening device runs, before fiber feeding to the fiber collection surface has been turned on. In this way, a simple time clock is sufficient to ascertain the combed-out state.

In order to carry out the process according to the invention, the invention provides for a device of this type to be equipped with control means which act upon the mechanism for the deflection of the fiber stream in such manner that the fiber stream reaches the fiber collection surface as a function of yarn back-feeding before the fiber stream has reached its full operating strength after switching on of the fiber feeding device. Such a device makes it possible to obtain improved piecing joints.

In a preferred embodiment of the invention, the control device for the suction device contains an adjustable time control element which determines the time interval between switching on the fiber feeding device and the switching off of the suction device. This time control element is started up at the moment when the fiber feeding device is switched on, and is set to the time which must expire before the suction device is switched off.

In an advantageous embodiment of the invention, the time control element is connected to a device which ascertains the combed-out state of the fiber tuft at the moment of piecing and determines the time interval as a function of this combed-out state.

The process, according to the invention, is very simple and can also be realized in a simple manner after construction by making minor changes in the normal control device for piecing. Neither are complicated control devices with narrow tolerances necessary to achieve adaptation of the yarn draw-off acceleration to the increase of the fiber stream in the spinning device The process, according to the invention, and the device, according to the invention, can be applied to the widest range of processes and devices of this type (e.g., British Pat. No. 1,170,869, which corresponds to U.S. Pat. No. 3,521,440; German Patent Application No. 1,901,442, which corresponds to British Patent No. 1,296,461; German Patent Application No. 1,932,009, which corresponds to British Patent No. 1,228,534; German Patent Application No. 3,104,444, which corresponds to U.S. Pat. No. 4,384,451; and German Patent Application No. 3,118,382, which corresponds to U.S. Pat. No. 4,497,166).

BRIEF DESCRIPTION OF THE DRAWINGS

The invention shall be explained in greater detail below through drawings in which.

DETAILED DESCRIPTION OF THE INVENTION

Figure 4:
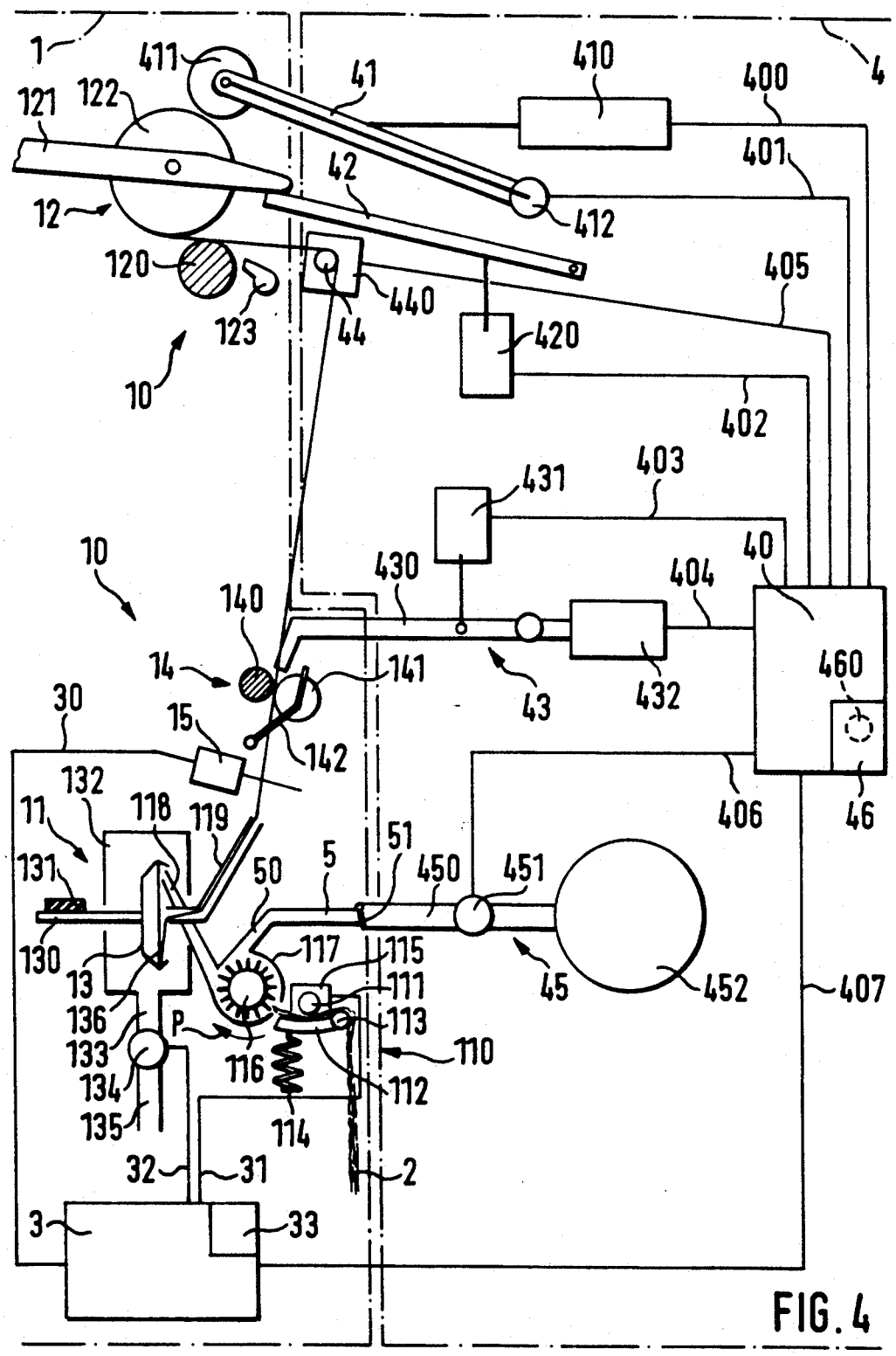
FIG. 4 shows a spinning station of an open-end spinning machine, in accordance with the invention.

The device to carry out the process shall first be described through FIG. 4 to the extent required in order to explain the goal to be achieved and the new process.

FIG. 4 shows, in its left half, a schematic representation of a spinning station 10 of an open-end spinning machine 1. The spinning station 10 is provided with an open-end spinning device 11 and with a winding mechanism 12.

Each open-end spinning device 11 is equipped with a fiber feeding device 110 to feed a fiber sliver 2 to an opening device 116. The fiber feeding device 110 (in the embodiment shown) consists of a delivery roller 111 and of a feeding tray 112 interacting elastically with it. The feeding tray 112 is mounted so as to be capable of swiveling on an axle 113 and is pressed elastically against the delivery roller 111 by means of a spring 114. The delivery roller 111 is driven via a controllable coupling 115 by a central drive (not shown).

The opening device 116, in the embodiment shown in FIG. 4, is designed essentially in the form of an opening roller placed in a housing 117. From it, a fiber feeding channel 118 extends towards a spinning element 13 which, in the embodiment shown, is made in form of a spinning rotor. The spinning element 13 is driven or braked in the conventional manner. In the embodiment shown, the spinning element 13, in form of a spinning rotor, is provided with a shaft 130 against which a tangential belt 131 is applied and which can be lifted off from it. The spinning element 13 is located in housing 132 which is provided with a suction opening 133 connected via a controllable valve 134 and a suction circuit 135 to a source of negative pressure which is not shown here.

To guide the yarn 20, which is to be drawn off from the spinning element 13, a yarn draw-off pipe 119 is provided. Draw-off is effected by means of a pair of draw-off rollers 14 consisting of a driven draw-off roller 140 and of a draw-off roller 141 in elastic contact with it and driven by it. For this purpose, the draw-off roller 141 is mounted on a swivel arm 142.

On its way from the open-end spinning device 11 to the pair of draw-off rollers 14, yarn 20 is monitored by a yarn monitor 15.

The yarn 20 is wound up on the winding mechanism 12 which is provided with a driven winding roller 120 for that purpose. The winding mechanism 12 is also equipped with a pair of pivoting bobbin arms 121 which hold a rotatable bobbin 122 between them. The bobbin 122 lies on the winding roller 120 during the undisturbed spinning process and is, therefore, driven by it. The yarn 20, to be wound up on the bobbin 122, is inserted into a traversing yarn guide 123, moving back and forth alongside the bobbin 122 and thus ensuring even distribution of the yarn 20 on the bobbin 122.

The yarn monitor 15, the coupling 115 and the valve 134 are connected, for control, to a computer unit or control device 3 via circuits 30, 31 and 32. Control device 3 contains a time measuring element 33 which measures the time from the moment of stopping the fiber feeding device 110 to the beginning of the piecing process. More details shall be described further below.

A service unit 4 is capable of traveling alongside the open-end spinning machine with a plurality of identical spinning stations 10. The service unit 4 also contains a control device 40 which is connected, for control, to the computer unit or control device 3 via a circuit 407 to control the piecing process. The control device 40 is also connected via a circuit 400 to the swivel drive 410 of a swivel arm 41 which is provided, at its free end, with an auxiliary drive roller 411. The auxiliary drive roller 411 is driven by a drive motor 412 which is also connected, for control, with the control device 40 via a circuit 401.

Swivel arms 42 mounted on the service unit 4 can be advanced to the bobbin arms 121 of mechanism 12 and are capable of swiveling, their swivel drive 420 is connected for control via a circuit 402 to the control unit 40.

A lift-off device 43 can be advanced to the draw-off roller 141 of the pair of draw-off rollers 14. This lift-off device is provided with a swivel arm 430 capable of working together with the swivel arm 142 of the draw-off roller 141. For this purpose, the swivel arm 430 is connected to a swivel drive 431 and to a lifting drive 432, said drives being connected, in turn, for control, via circuits 403 or 404 to the control unit 40.

The service unit 4 is also equipped with a yarn disposal device 44 with a driving device 440, controlled via a circuit 405 from the control unit 40, as seen in more detail in U.S. Pat. No. 4,438,624, which is incorporated herein by reference.

The outlet 50 of a suction channel 5 opens into the housing 117 of the opening device 116 in the open-end spinning machine 1 (arrow P, as seen, indicates the direction of fiber movement) after the outlet of the fiber feeding channel 118, whereby the end of said suction channel 5, which is furthest from the opening device 116, can be closed by a butterfly valve 51. A suction channel 450 of an aspiration device 45 of the service unit 4 can be advanced to the suction channel 5 of the open-end spinning device 1. This suction channel 450 is connected via a valve 451 to a negative-pressure source 452. The valve 451 is, in turn, connected for control via a circuit 406 to the control device 40 which contains a time control element 46.

During normal spinning operation, the fiber sliver 2 is conveyed by means of the fiber feeding device 110 to the opening device 116, which opens the fiber sliver 2 into fibers which are fed to the fiber collection surface 136 of the spinning element 13 and are deposited there. The end of the yarn 20, which is in the process of being drawn off, is linked to this fiber accumulation which, in the spinning rotor of the embodiment shown as an example, constitutes a fiber ring and the yarn end incorporates the fibers into its end due to the rotation which it is imparted by the rotation of the spinning rotor, while the yarn 20 is drawn off by the draw-off rollers 14 from the open-end spinning device 11. The bobbin 122 lies in a known manner on the winding roller 120 during the spinning process and winds up the yarn 20 while the yarn guide 123 distributes the yarn on the bobbin 122 with a shot effect.

Figure 1:
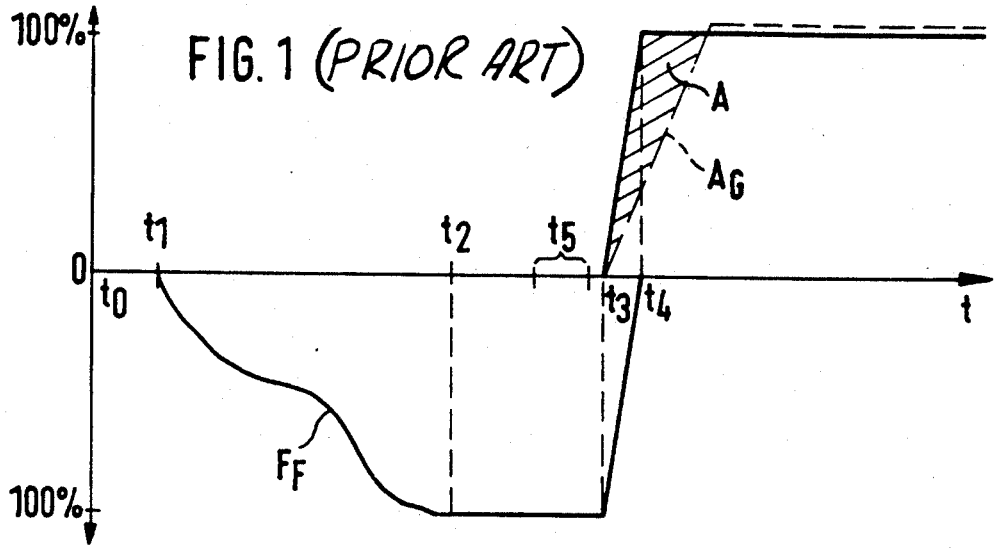
FIG. 1 (PRIOR ART)
FIG. 1 shows a diagram with the customary piecing switch-over of fiber stream and yarn draw-off.
Figure 2:
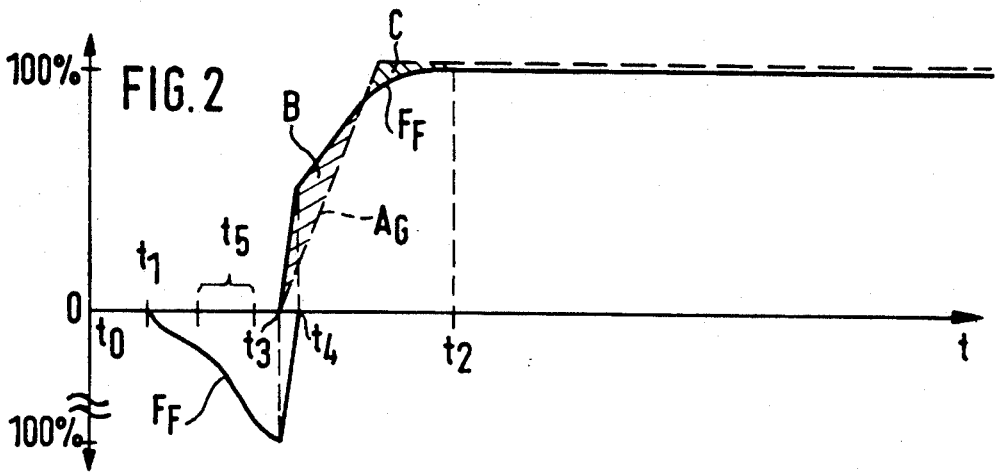
FIG. 2 shows a diagram with the switch-over of the fiber stream according to the invention and with yarn draw-off adapted thereto.
Figure 3:
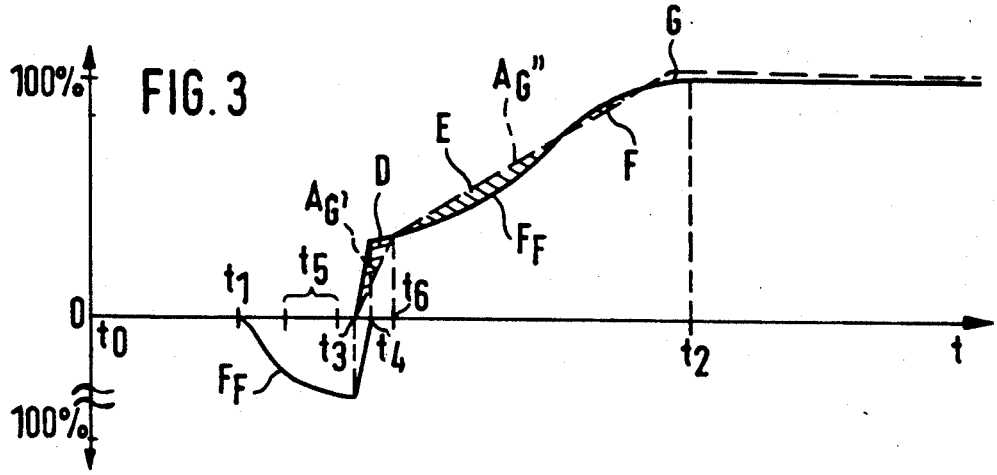
FIG. 3 shows a diagram with the curve for fiber feeding and the curve for yarn draw-off during piecing following a stoppage of prolonged duration.

Referring now to FIGS. 1, 2, and 3, which illustrate diagrammatically the fiber flow through the apparatus of FIG. 4. In these figures, the lines of each of the diagrams have the following meanings:

| Symbol | Meaning |
|---|---|
| Full line = | Fiber flow path |
| Horizontal line t = | Process time line |
| Full line below line t = | Fiber flow into the auxiliary suction channel 5 |
| Full line above line t = | Fiber flow into the spinning element |
| Broken line above line t = | Yarn withdrawal |
| Vertical broken lines = | Reference time lines for $t_2$, $t_3$, etc. |
| 100% above line t = | Full fiber flow into spinning element |
| 100% below line t = | Full fiber flow into auxiliary suction channel 5 |

Before explaining the new piecing process, the present, conventional piecing process shall be reviewed through FIG. 1. For the sake of clarity, the rotor speed, which is controlled in the conventional manner, has not been represented on the drawing.

The fiber flow $F_F$, which is effective in the spinning element 13, has been shown on the vertical axis of the diagram by a full line going up. The yarn draw-off $A_G$ has also been shown by means of a broken line going up. The fiber flow $F_F$, which is fed into the suction channel 5 and, therefore, does not reach the spinning element 13, has been represented by a full line $F_F$ going down.

The time t is entered on the horizontal time line. At the point in time $t_O$, the piecing program is started. At the point in time $t_1$, the fiber feeding device 110 begins to run so that the fiber flow $F_F$ starts up again. Since the forward fiber sliver end, constituting a fiber tuft, which continues to be presented to the opening device 116 has been combed out to a greater or lesser extent during the prior stoppage time so that said fiber tuft is not considerably thinner than during normal production, the fiber tuft must first be advanced over a certain distance until a fiber tuft which is identical to one during production can again be presented to the opening device 116. It is also necessary for the fibers presented to the opening device 116 fill the clothing of the opening device 116 and be conveyed by it. A certain amount of time is necessary for this, and for that reason the run-up curve of the fiber flow $F_F$ is more or less steep.

According to FIG. 1, the fiber flow $F_F$ has reached 100%, i.e., its full strength at the point in time $t_2$. At any chosen point in time $t_3$ after the full fiber flow $F_F$ has been reached, the latter is switched over in known processes, so that 100% of the fibers go to the fiber collection surface 136 of the spinning element 13 as of point in time $t_4$.

Synchronized in time with the release of the fiber flow $F_F$, a yarn end is fed back into the spinning rotor or to another spinning element 13 during the time period $t_5$ so that it may combine with the fibers arriving there. In synchronization with the point in time $t_3$, possibly coincidentally with it or slightly earlier or later, yarn draw-off $A_G$ then begins and runs up with acceleration to its production speed (100%). As shown in FIG. 1, a certain amount of time is required for this step. The run-up time of the yarn draw-off $A_G$ can be shortened only when the yarn drawoff $A_G$ is not effected by means of roller 122 but by means of the pair of draw-off rollers 14. In that case, an excess of yarn which must be buffer-stored appears between the pair of draw-off rollers 14 and the bobbin 122, and it must be used up again once the bobbin 122 has reached its full speed.

To avoid such storage, another process is provided according to FIG. 2. As with the process according to FIG. 1, the fiber flow $F_F$ first goes into the suction channel 5 as of point in time $t_1$ and is taken away via the suction channel 45, so that no fibers reach the fiber collection surface 136 of the spinning element 13. In contrast to the old, known process according to FIG. 1, however, the renewed deflection of the fiber flow $F_F$ and its transportation to the fiber collection surface 136 of the spinning element 13 occurs long before the point in time $t_2$ is reached, so that as of point in time $t_4$, which comes before the point in time $t_2$, all the fibers reach the spinning element 13. The switch-over of the fiber flow $F_F$ and its transportation to the spinning element 13 thus takes place during the run-up of the fiber flow $F_F$, i.e., before the fiber stream or fiber flow $F_F$ released as a result of the fiber feeding device 110 having been switched on has reached its full production strength. The end of yarn 20 which has been prepared in the customary manner is back-fed during the period $t_5$ to the fiber collection surface 136 of the spinning element 13. The yarn draw-off $A_G$ begins at that time. Since the run-up curve of the fiber flow $F_F$ is considerably flatter with the new process according to FIG. 2 than with the known process according to FIG. 1, the run-up of the speed of the yarn draw-off $A_G$ is easy to control and to adapt to the run-up curve of the fiber flow $F_F$, so that the run-up of the yarn draw-off $A_G$ deviates only insignificantly from the run-up curve of the fiber flow $F_F$. This means that the piecing joint now deviates only insignificantly from the normal yarn thickness, and thereby from the desired thickness. This appears clear from FIGS. 1 and 2. While the excess of fibers is quite considerable according to FIG. 1 (see shaded triangle A), so that a comparatively voluminous and thereby noticeable thick spot is produced in the area of the piecing joint of the newly pieced yarn 20, the process according to FIG. 2 produces, first of all, an unobtrusive thick spot (see shaded triangle B) and also an equally unobtrusive thin spot (see shaded triangle C) in the yarn 20. As can be seen clearly from a comparison between the triangles B and C and the triangle A, the triangles B and C are considerably smaller than triangle A, signifying that the degree to which the yarn thickness deviates from the desired value is considerably smaller with a process according to FIG. 2 than with the known process according to FIG. 1.

FIG. 3 shows the new piecing process after a lengthy stoppage of the spinning station. Because of the continued running of the opening device 116, even after stoppage of the fiber feeding device 110, the fiber tuft continues to be impaired, a process which can result from combing out or from partial grinding of the fibers of the fiber tuft, depending on the design of the fiber feeding device 110. The longer time during which the opening roller has this effect, corresponding to this longer stoppage time, also causes the fiber tuft to be further impaired, so that it takes longer before the fiber sliver 2 can be opened in a normal fashion by the opening device 116 once the fiber feeding device 110 has been switched back on. The interval between the times $t_O$ and $t_1$ is, therefore, greater according to FIG. 3 than in the case illustrated by FIG. 2.

As shown in FIG. 3, the yarn draw-off $A_G$ can also contain a varying acceleration to adapt to the run-up curve of the fiber flow $F_F$. Thus, the yarn draw-off is, for instance, accelerated between the points in time $t_4$ and $t_6$ (phase $A_G'$) to a maximum, until the yarn draw-off speed has reached, expressed in percentages of its production speed, the same value as the fiber flow $F_F$. The yarn draw-off speed is then accelerated less (phase $A_G''$), so that the fiber flow $F_F$ and the yarn draw-off $A_G$ reach full value (100%) essentially at the same time.

As shown in FIG. 3, only small deviations occur between the fiber flow $F_F$ and the yarn draw-off $A_G$, whereby the thick spots represented by the shaded triangles D and F and the thin spots represented by the shaded triangles E and G are negligibly minimal.

Following this outline of the principle of the new process, it shall be further explained through the device the design of which has already been described.

If a yarn breakage occurs, this is signaled by the yarn monitor 15 to the control device 3 which actuates the time measuring element 33. At the same time, the coupling 115 of the fiber feeding device 110 is actuated and stops the delivery roller 111 and thereby stops the feeding of the fiber sliver 2 to the opening device 116. In a manner not shown here, the bobbin 122 is also lifted off the winding roller 120 so that the end of the yarn 20 cannot be wound onto the bobbin surface by the continuously running bobbin 122. Furthermore, the spinning element 13 is stopped in a conventional manner. The opening device 116, however, continues to run without interruption.

After a certain time span, the service unit 4 arrives at this spinning station 10 where the yarn 20 broke. For this, the service unit 4 can be summoned to this spinning station by a known calling device (not shown); however, the service unit 4 can also patrol continuously alongside a defined number of spinning stations and thus, arrive at the spinning station 10 which is affected by a yarn breakage. When the service unit 4 has reached the spinning station 10 in question, its control device 40 scans the control device 3 via a circuit 407 and learns in this way whether service is required or not at the spinning station 10 in question. The control device 3 is designed so that it only transmits that information to the service unit 4 which concerns the spinning station 10, where the service unit 4 is present at that time.

When the service unit 4 is at a spinning station 10 needing to be serviced, the service unit 4 stops. The bobbin arms 121 are supported in the manner already described by the swivel arms 42 against the bobbin lifting device on the machine side. Furthermore, the auxiliary drive roller 411 is advanced to the bobbin 122. The suction channel 450 of the service unit 4 is, furthermore, advanced to the suction channel 5 on the machine side. Furthermore, the draw-off roller 141 is lifted off the driven draw-off roller 140 by means of the lift-off device 43, and the yarn 20 is drawn off in the normal way from the bobbin 122 which has been lifted off the winding roller 120, and is back-fed into the yarn draw-off pipe 119. The yarn is thereby laid across the yarn ejection device 44 and is held there.

During that time the spinning element 13 is cleaned in a known manner. The fibers and dirt particles taken from the spinning element 13 are removed through the suction channel 133 by means of the negative spinning pressure applied as always in the housing 132.

After the cleaning of the spinning element 13, the valve 134 for the negative spinning pressure is closed and the valve 451 for the suction channel 450 is reopened. Furthermore, the spinning element 13, which had been stopped until now, is again released and now runs up to is production speed or to a predetermined piecing speed. The piecing program can be written so that piecing is carried out either at a constant speed of the spinning element 13 or during its run-up curve. If piecing is carried out at a reduced but constant rotor speed, the spinning rotor is preferably brought up to its production speed in such manner that its run-up curve is essentially synchronized with those of the fiber flow $F_F$ and of the yarn draw-off $A_G$ or is extensively adapted to same.

At the beginning of the piecing program, i.e., at the beginning of the task undertaken by the service unit 4 at the spinning station 10 in question, the control device 3 transmits an impulse to the time measuring element 33 which has thus recorded the stoppage time of the fiber feeding device 110, from the moment of yarn breakage to the beginning of the piecing process, with the opening device 116 continuing to run uninterruptedly. The fiber feeding device 110 is then switched back on through actuation of the coupling 115. The fiber sliver 2 is thereby again fed to the opening device 116, but is again sucked away from it and out of the housing 117 by the negative pressure source 452 taking effect. At the point in time $t_3$, which is determined by the control device 3 as a function of the stoppage time recorded by the time measuring element 33, the valves 134 and 451 are now actuated, so that no negative pressure prevails, any longer, in the suction channel 5, while negative spinning pressure is applied, instead, once more in housing 132 via suction circuit 135. The fibers entering the housing 117 of the opening device 116 are thus sucked through the fiber feeding channel 118 to the spinning element 13 where they are deposited in a known manner on the collection surface 136.

The point in time $t_3$ which is determined by the control device 3 and at which the negative pressure is switched on at the suction circuit 135, is selected so that the fiber flow $F_F$ has not yet reached its full strength. The control means mentioned (control device 3, valves 134, 451) are used to act upon the mechanism (aspiration opening 133, suction channel 5) for the deflection of the fiber flow $F_F$ in such manner that said fiber flow $F_F$ reaches the fiber collection surface 136 as a function of the yarn back-feeding. As mentioned earlier, this switch-over is effected in such manner that the fiber flow $F_F$ or fiber stream has not yet reached its full production strength after switching on of the fiber feeding device 110.

In the control device 3, storage is carried out (depending on fiber material, staple fiber length, design of the fiber feeding device 110, etc.) as the fiber flow $F_F$ increases during corresponding stoppage periods. In this way, yarn draw-off $A_G$ can also be controlled as a function of this curve, and can be adapted to the increase of the fiber flow $F_F$. The yarn draw-off $A_G$ is switched on by the control device 3 via control device 40 of the service unit 4 at the point in time $t_3$ when the fiber flow $F_F$ becomes effective in the spinning element 13, or shortly before, or shortly after this point in time $t_3$, and is accelerated in accordance with the curve indicated by control device 3. This acceleration can be controlled in a linear manner or according to any desired curve, depending on the run-up curve of the fiber flow $F_F$ which has been entered into the control device 3. In that case, control is effected by means of the auxiliary drive roller 411. However, it is also possible to control the yarn draw-off curve by means of the draw-off roller 141 by controlling the contact pressure of the draw-off roller 141 by means of the lift-off device 43. Since the fiber tuft is combed out more during a long stoppage of the open-end spinning device 11 than during a short one, this is taken into account in the control of yarn draw-off $A_G$ which is, therefore, controlled as a function of the combed-out state of the fiber tuft. For this reason the combed-out state of the fiber tuft is first ascertained. The yarn draw-off $A_G$ is then controlled as a function of this state in such manner that the yarn draw-off speed is accelerated more slowly when the fiber tuft has been greatly impaired (long stoppage of the open-end spinning device 11) than when it has been impaired to a lesser extent. In addition, or instead, the yarn draw-off $A_G$ can also begin earlier (little impairment) or later (great impairment) depending on the impairment of the fiber tuft.

The fiber flow $F_F$ has reached its full strength at the point in time $t_2$. Thus, the pressure roller 141 can again be pressed against the driven draw-off roller 140 after this point in time $t_2$ by means of the lift-off device 43, and the draw-off of yarn 20 from the spinning device 11 can be effected by means of the draw-off device 14. The bobbin 122 can now be lowered on the winding roller 120, whereupon the auxiliary drive roller 411 is lifted off from the bobbin 122.

If desired, the acceleration of the spinning element 13 can also be controlled as a function of the run-up of the fiber flow $F_F$.

The described process and also the described device can be varied in many ways, for example, by replacing individual characteristics by equivalents or through other combinations thereof. Thus, it is not necessary to design the spinning element 13 in form of a spinning rotor, but other open-end spinning elements, e.g., friction spinning rollers, etc., can be used here. Neither is it necessary to provide a separate negative-pressure source 452 on the service unit 4, but the suction channel 450 can also be connected in a known manner to a negative-pressure source to which the suction circuit 135 is connected, on the machine.

It is also possible to drive the drive roller 140 via a controllable slippage coupling (not shown) from a drive shaft and to control it as a function of the effective slippage of the yarn draw-off $A_G$.

As an alternative of the time measuring element 33 in the open-end spinning machine 1, it is also possible to provide a setting key 460 for the time control element 46 on the service unit in order to manually set the time $t_1$. This can be done as a function of various factors (state of the fiber tuft, fiber material, staple fiber length, distance from the nip between delivery roller 111 and feeding tray 112, or other counter-element interacting with the delivery roller 111, to the operating zone of the opening device 117, etc.)

Neither is it necessary to derive the state of the fiber tuft from the stoppage time of the fiber sliver 2 (while possible taking into account other factors), but it can absolutely be determined in some other way, e.g., optically, by measuring the air resistance, etc., in case that this might prove desirable.

We claim:

1. A process for piecing yarn on an open-end spinning device which includes means for feeding fiber to an opening device, means for conveying a stream of opened fibers in an air stream to a fiber collection surface of a spinning element, and means for drawing off spun yarn from said fiber collection surface of said spinning element, comprising the following steps:

(a) detecting a missing yarn in said spinning device;
(b) stopping the feed of fiber material to said opening device;
(c) shifting said air stream from said fiber collection surface;
(d) backfeeding a yarn to said fiber collection surface;
(e) restarting the feeding of a fiber tuft to said opening device;
(f) feeding said fibers into said shifted air stream;
(g) completely shifting the entire said air stream from said opening device to said fiber collection surface so that a single full air stream from said opening device is directed to said fiber collection surface and all of the fibers entering the air stream from said opening device air directed fully to said fiber collection surface before the fiber density in said completely shifted air stream attains full production density strength; and
(h) drawing off yarn from said fiber collection surface as the fiber density in said air stream increases to its full production strength.

2. A process as set forth in claim 1, including the further steps of collecting said shifted fiber stream in a suction device and turning off said suction device after the fiber feeding is restarted and before said fiber stream attains its fiber production density.

3. A process as set forth in claim 1, including the further steps of detecting the combed out state of said fiber tuft submitted to said fiber opening device and controlling the shifting of the pneumatic stream of fibers to said fiber collection surface as a function of the detected combed out state of the said fiber tuft fed to said opening device.

4. A process as set forth in claim 3, including the further step of controlling the yarn draw-off speed so that the draw-off speed increases more slowly when the fiber tuft is more impaired than when it is less impaired.

5. A process as set forth in claim 3, including the further step of beginning the yarn draw-off step later in the case of great impairment of said fiber tuft fed to said opening device than in the case of lesser impairment.

6. A process as set forth in claim 1, including the further steps of ascertaining the combed out state of said fiber tuft presented to said opening device and controlling at least one of the beginning and the speed of the yarn draw-off as a function of the ascertained state of said fiber tuft.

7. A process as set forth in claim 6, including the further step of determining the combed out state of said fiber tuft presented to said fiber opening device by measuring the period of time as said fiber feeding device is stopped while the fiber opening device continues to run while said air stream is shifted away from said fiber collection surface.

8. An open-end spinning machine with a device for piecing yarn on an open-end yarn spinning device which has a fiber collection surface, a fiber feeding device, a fiber opening device, a yarn draw-off device for drawing spun yarn from said fiber collection surface, and means for feeding a stream of opened fibers in an air stream from said fiber opening device to said fiber collection surface, said piecing device comprising;

(a) means for detecting a missing yarn in said open-end spinning device;

(b) control means from stopping the fiber feeding device when a missing yarn is detected;

(c) means to shift said air stream from said fiber collection surface to waste collector when a missing yarn is detected;

(d) means for backfeeding a yarn to said fiber collection surface for piecing;

(e) control means for restarting the fiber feeding means and for feeding fibers to said air stream; and (f) control means for completely shifting the entire said air stream from said opening device to said fiber collection surface so that the full air stream from said opening device is directed to said fiber collection surface and all of the fibers entering the air stream from said opening device are directed fully to said fiber collection surface before the fiber density in said completely shifted air stream reaches its production strength density.

9. An open- end spinning machine as set forth in claim 8, wherein said waste collector includes a suction device which is controlled by a time control means which is adjustable for adjusting the time interval between the switching on of the fiber feeding device and the switching off of the suction device of said waste collector.

10. An open-end spinning machine as set forth in claim 9, wherein said time control means is connected to a means for ascertaining the combed out state of the fiber tuft fed to said opening device at the time of the piecing process and adjusts the time interval as a function of said combed out state of said fiber tuft.

* * * * *